US006857890B2

(12) United States Patent
Kammerer et al.

(10) Patent No.: US 6,857,890 B2
(45) Date of Patent: Feb. 22, 2005

(54) SYMMETRICAL CONNECTOR

(75) Inventors: Dietmer Kammerer, Ludwigsburg-Poppenweiler (DE); Thomas Bürk, Bad Liebenzell (DE)

(73) Assignee: Hirschmann Austria GmbH, Rankweil Brederis (AT)

( * ) Notice: Subject to any disclaimer, the term of this patent is extended or adjusted under 35 U.S.C. 154(b) by 0 days.

(21) Appl. No.: 10/616,952

(22) Filed: Jul. 11, 2003

(65) Prior Publication Data

US 2004/0038577 A1 Feb. 26, 2004

(30) Foreign Application Priority Data

Jul. 13, 2002 (DE) ..... 102 31 715

(51) Int. Cl.[7] ..... H01R 13/62
(52) U.S. Cl. ..... 439/312; 439/358; 439/170
(58) Field of Search ..... 439/353, 357, 439/358, 350, 352, 354, 312, 170

(56) References Cited

U.S. PATENT DOCUMENTS

| | | | | | |
|---|---|---|---|---|---|
| 4,255,007 | A | * | 3/1981 | Michaels et al. | 439/332 |
| 5,637,010 | A | * | 6/1997 | Jost et al. | 439/352 |
| 5,762,514 | A | * | 6/1998 | Long et al. | 439/358 |
| 5,823,813 | A | * | 10/1998 | Dye | 439/347 |
| 6,464,526 | B1 | * | 10/2002 | Seufert et al. | 439/352 |
| 2002/0031933 | A1 | | 3/2002 | Nakamura | |

* cited by examiner

*Primary Examiner*—P. Austin Bradley
*Assistant Examiner*—X. Chung-Trans
(74) *Attorney, Agent, or Firm*—Fulbright & Jaworski, LLP

(57) ABSTRACT

A connector (1) with a contact carrier (2) which has several receiving areas (9) for contact partners and a contact carrier sleeve (5) which can be moved over the contact carrier (2) and fixed there and which has a catch device (6) for locking the connector (1) to a mating connector. The invention providing that the contact carrier (2) and the contact carrier sleeve (5) are made symmetrical to each other such that the contact carrier sleeve (5) can be moved both into a first position and also into at least one second position over the contact carrier (2) and can be fixed in the selected position.

8 Claims, 4 Drawing Sheets

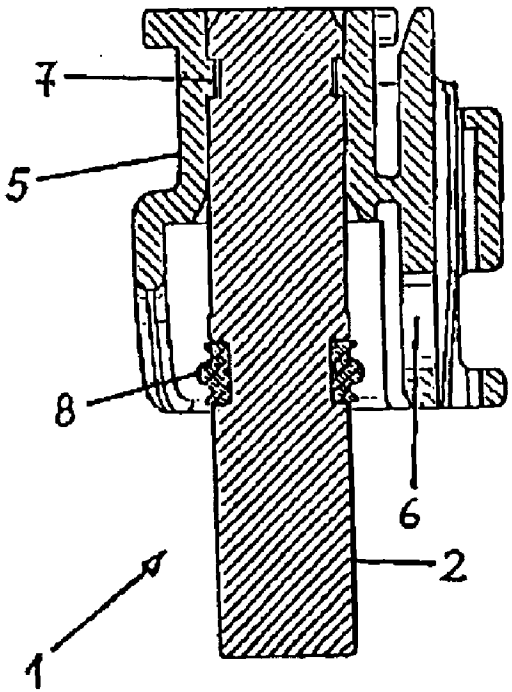
FIGUR 1c
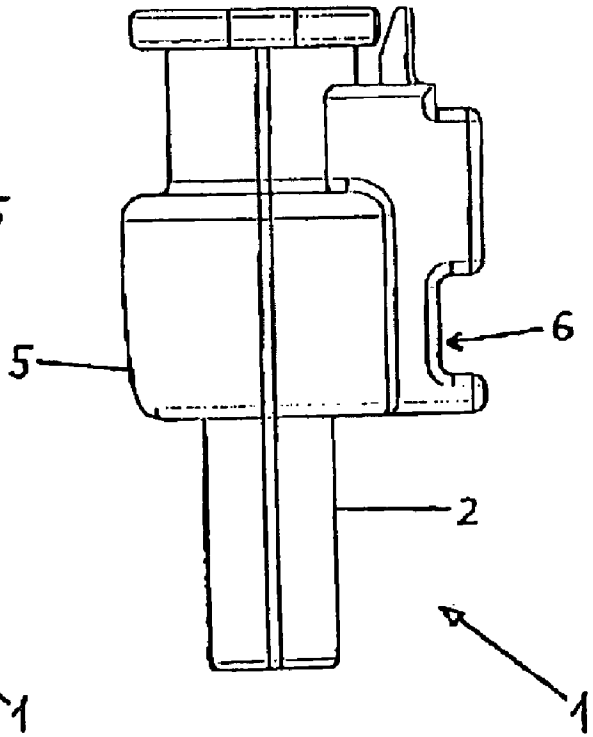
FIGUR 1b
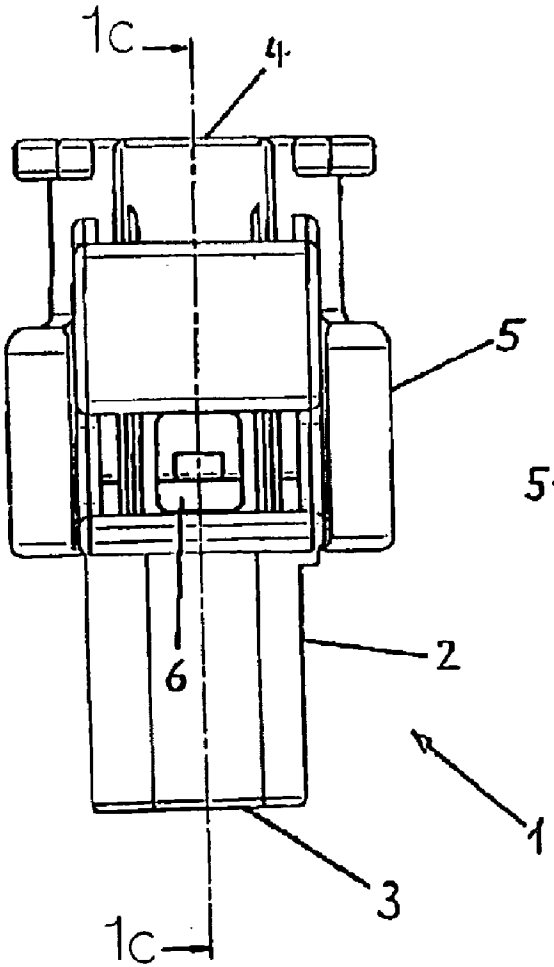
FIGUR 1a

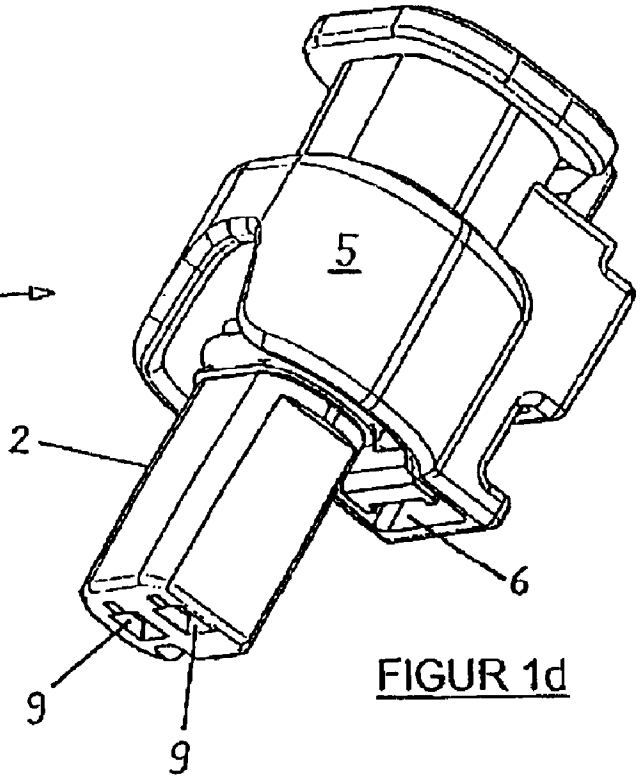
FIGUR 1d
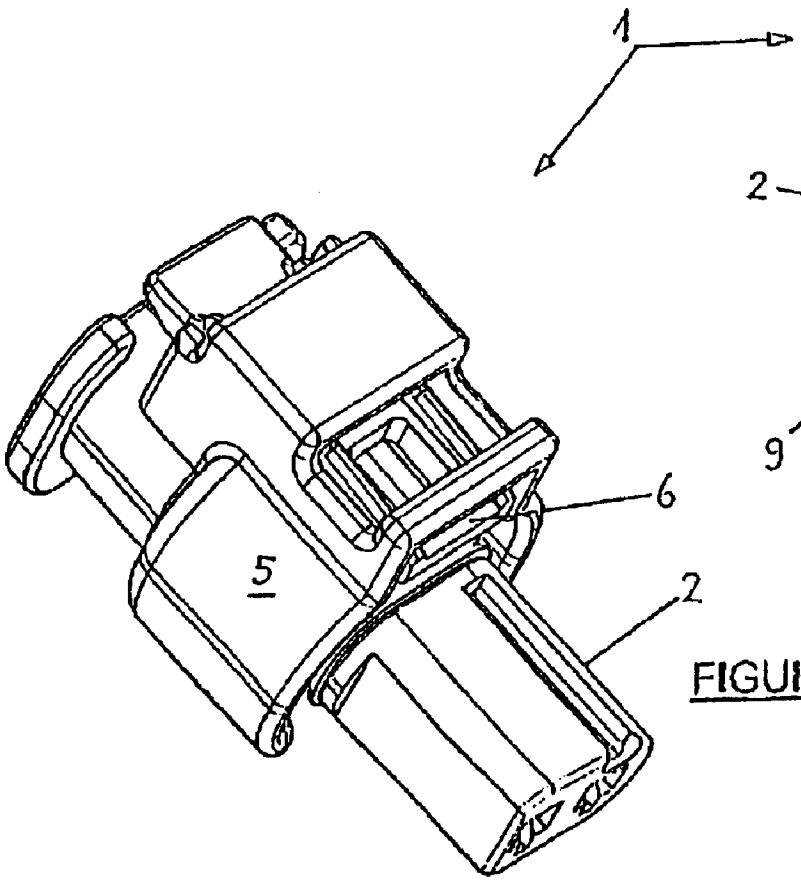
FIGUR 1e

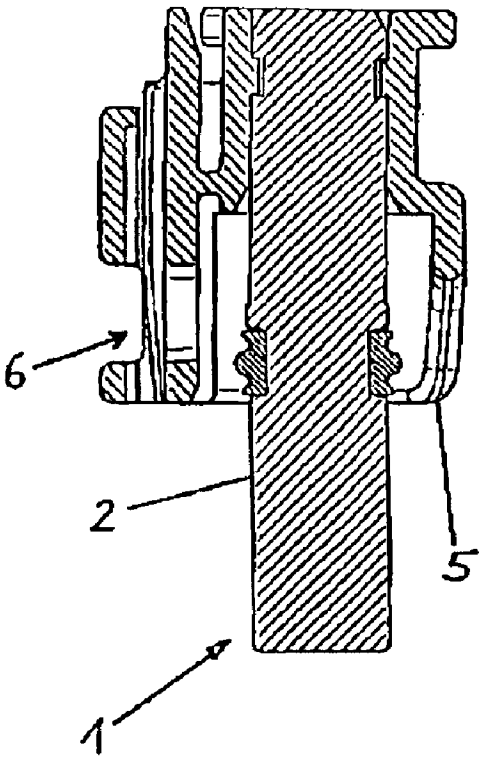
FIGUR 2c
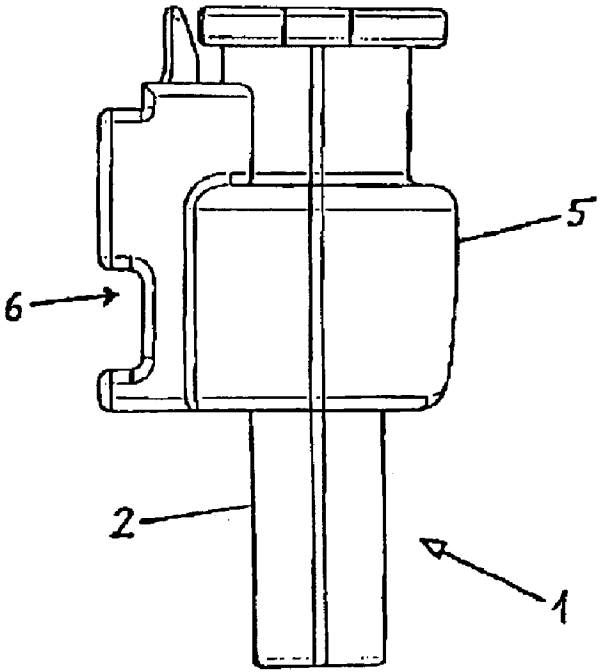
FIGUR 2b
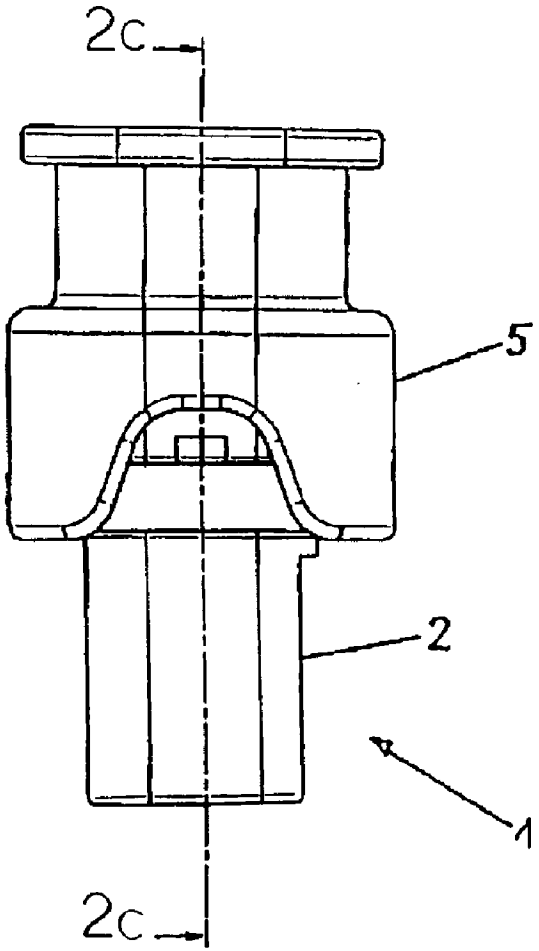
FIGUR 2a

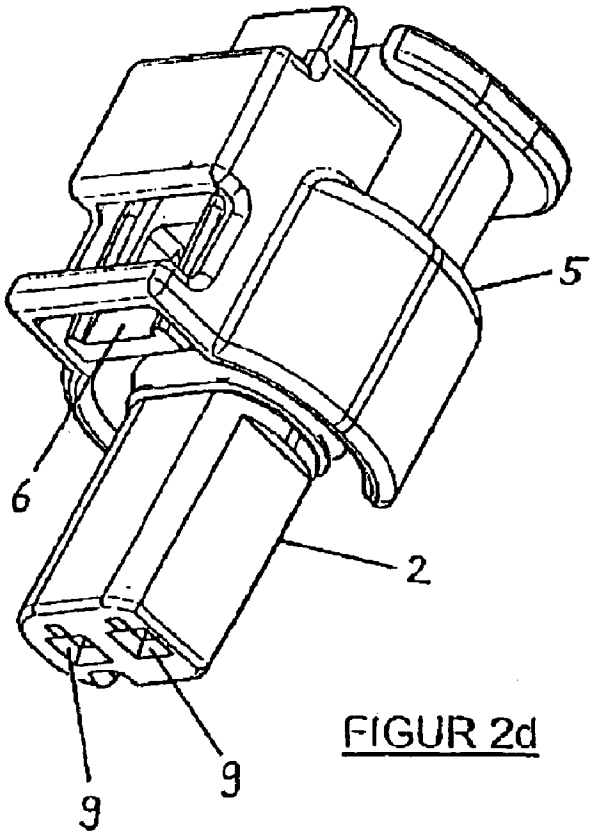
FIGUR 2d
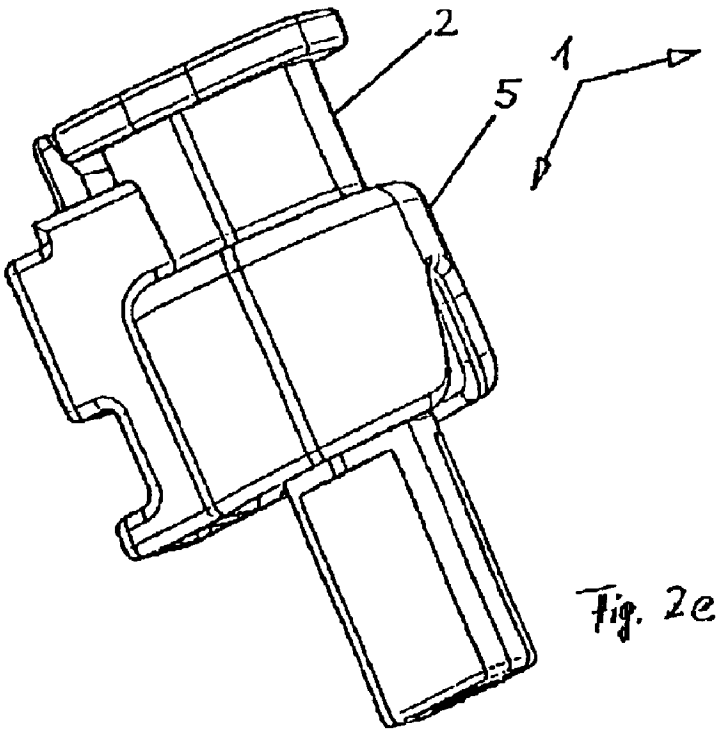
Fig. 2e

SYMMETRICAL CONNECTOR

BACKGROUND OF THE INVENTION

CROSS-REFERENCE TO PRIOR APPLICATION

All priority rights as authorized by statute are claimed for this application from German Patent Application No. 102 31 715.1 filed on Jul. 13, 2002.

1. Field of the Invention

The present invention relates to an electrical connector with a contact carrier and a contact carrier sleeve that can have its exterior geometry changed while preserving an electrical contact arrangement, and more particularly to a connector having a contact carrier sleeve that can be rotated about the contact carrier.

2. Description of the Related Technology

Connectors having a contact carrier and a contact carrier sleeve are known. The prior known contact carriers have receiving areas (for example in a shaft-like form) into which contact partners such as sleeves or pins can be inserted and fixed. The receiving areas can be arranged next to one another in a row, several rows of contact partners located next to one another and on top of one another also being possible. The contact partners are connected on their other ends to electrical lines such as round cables, flat conductors and the like. Connecting the lines to the contact partners and their arrangement in the receiving areas in the contact carrier necessarily dictate an assembled contact-making sequence or pattern. At the same time the contact carrier sleeve, which can be moved and fixed over the contact carrier and which has catch devices, ensures that with its catch devices the assembled connector consisting of the contact carrier and the contact carrier sleeve located over it can be arranged and attached to a second mating connector. In existing connectors the contact carriers and the contact carrier sleeves are made such that they only can be moved and fixed or attached jointly in a single position to one another. In conjunction with having a given contact-making sequence for the contact partners in the receiving areas of prior known connectors there is a consequence that these connectors which are built in this way are only able to make contact with a mating connector in a single relative orientation. In particular, as a result of the presence of catch devices being on the contact carrier sleeve for locking onto mating connectors it can happen that in a connection between a prior known connector and another prior known mating connector that the elements which project beyond the contact carrier sleeve, such as catch devices, are in the way and there is not enough room so that the catch devices hinder making a connection between the connector and the mating connector. Changing the contact-making sequence generally cannot be considered since these connectors, especially for applications in the automobile industry, are prefabricated with the corresponding lines or the contact-making sequence fixed by the mating connector and not amenable to change. Likewise, changing the structural space arrangements is precluded since they also are permanently defined or cannot be changed for geometrical reasons.

SUMMARY OF THE INVENTION

An object of the present invention is to improve generic connectors having contact carrier sleeves such that versatile use of these connectors is at the same time possible while maintaining a previously set contact-making sequence or arrangement once it has been defined.

The present invention provides a connector having a contact carrier and a contact carrier sleeve that are made to be symmetrical such that the contact carrier sleeve can be moved both into a first position and also into at least one different second position over the contact carrier and can be fixed in either position. This means that the contact carrier sleeve can be moved (pushed) first in the prefabrication of the connector into a first position over the contact carrier and can be fixed there. If this completed assembly between the contact carrier and contact carrier sleeve with its catch device on the contact carrier sleeve is in the way so as to create a space or a geometrical conditions conflict and an attachment contact with a mating connector can not be made, the present invention provides that the contact carrier sleeve can be detached from the contact carrier, moved into at least a second position, and fixed there. Afterwards, with the same contact-making sequence for the contact partners in the contact carrier the catch device of the contact carrier sleeve will no longer be in the way so that contact-making with a mating connector which dictates a certain unchangeable contact-making sequence is enabled.

Likewise the present invention advantageously offers the possibility that first the contact partners are arranged in a certain contact-making sequence in the contact carrier. A symmetrically made contact carrier sleeve then is provided for the not yet complete connector so that in the installation of a cable set it is possible to decide in what position the contact carrier sleeve can be arranged over the contact carrier.

In addition, there is another advantageous application of the invention in which first a cable set is prefabricated. This prefabrication consists in having the contact partners which are connected on the ends of the electrical lines arranged in the receiving areas (chambers) of the contact carrier. Then the contact carrier sleeve is positioned and fixed on the assembled contact carrier. If at this point in the installation of the prefabricated cable set at the installation site it is determined that the connector cannot be connected to a mating connector because of a lack of sufficient space, the contact partners can be removed from the finished connector (contact carrier with a contact carrier sleeve located over it in the first position) and rearranged to have in a new contact carrier position while maintaining the already established contact-making sequence. Then the contact carrier sleeve is placed over the already assembled contact carrier, but now in at least a second position which makes it possible for this prefabricated cable set with its connector on the end at the installation site to make correct contact with the mating connector. It likewise is feasible to insert the contact partner which has been removed from a first finished connector into another finished connector in which the contact carrier sleeve has already been fixed on the contact carrier in a second or another position (therefore altered compared to the first position in the first finished connector). In this version of the present invention there is versatile use of the connector since exclusive "left" or "right" connectors need not be manufactured with the expenditure of the corresponding manufacturing tool costs, but the connector of the present invention with the same contact carrier sleeve and with the same contact carrier makes it possible to implement a "right" and a "left" connector while maintaining the contact-making sequence dictated by the mating connector.

Another aspect of the present invention is to have the contact carrier and the contact carrier sleeve have roughly rectangular cross sections that are matched to one another. Thus the contact carrier and contact carrier sleeve can be fixed in at least two positions by turning the contact carrier sleeve by 180°. This aspect for the present invention has advantages especially when the receiving areas are located in a row next to one another, optionally several rows on top of one another also being conceivable. In addition, a connector with a flat structure can be assembled using roughly rectangular cross sections. In addition to the roughly rectangular cross sections, other cross section shapes also are conceivable by which four or more different positions between the contact carrier and the contact carrier sleeve can be established. A symmetrical cross section is therefore advantageous because especially in the automated assembly of the contact carrier and the contact carrier sleeve there are multiple defined positions for these two parts to one another.

In yet another aspect for the present invention, the contact carrier sleeve has a catch system for fixing against the contact carrier that has at least one partially, especially completely peripheral projection, and the contact carrier corresponding to this projection has at least one partially, especially likewise completely peripheral recess or vice versa. These corresponding catch system structures on the contact carrier and on the contact carrier sleeve make it possible, before or after the corresponding prefabrication of the connector, to assign the contact carrier sleeve to the contact carrier according to the available installation space. Here these catch systems are made as detachable or alternatively permanent catch systems. Detachable catch systems are considered when the connector has been prefabricated, i.e. that the contact carrier sleeve has already been moved over the contact carrier and has been positioned there. If when using the connector, i.e. when it is being connected to a mating connector it is ascertained that the catch devices of the connector are in the way, the already completed locking can be released, the contact carrier sleeve can be removed from the contact carrier, turned and again seated on the contact carrier and positioned. If the catch systems between the contact carrier and the contact carrier sleeve are permanent, locking takes place only when the connector is installed. The catch systems of the present invention, therefore, ensure that while maintaining a contact sequence or arrangement for the contact carrier sleeve with its catch devices for the mating connector and optionally other elements can on the one hand be located in a first position and on the other in an at least a second position on the contact carrier.

BRIEF DESCRIPTION OF THE DRAWINGS

One embodiment of the present invention for a connector to which the invention however is not limited to and to which differences therefrom may occur to one skilled in the art without departing from the scope of the invention is described below and explained using the figures, wherein:

FIG. 1*a* shows a plan side view of a connector according to the present invention in which a contact carrier sleeve is located in a first position on a contact carrier;

FIG. 1*b* shows another plan side view of the connector shown in FIG. 1*a;*

FIG. 1*c* shows a sectional side view of the connector shown in FIG. 1*a* as taken along the line 1*c*—1*c;*

FIGS. 1*d* and 1*e* shows different perspective views of the connector shown in FIG. 1*a;*

FIG. 2*a* shows a plan side view of a connector according to the present invention in which the contact carrier sleeve is located in a second position on the contact carrier from that shown in FIG. 1*a;*

FIG. 2*b* shows another plan side view of the connector shown in FIG. 2*a;*

FIG. 2*c* shows a sectional side view of the connector shown in FIG. 2*a* as taken along the line 2*c*—2*c*; and FIGS. 2*d*–2*e* show different perspective views of the connector shown in FIG. 2*a*.

DETAILED DESCRIPTION

Shown in the figures are a plan side view (FIG. 1*a*), a different plan side view (FIG. 1*b*), and a sectional view (FIG. 1*c*) for a sample connector 1 according to the present invention which has a contact carrier 2. This contact carrier 2 has a contact-making side 3 via which it can be connected to a mating connector. The side facing away from the contact-making side 3 is made as the cable side 4, i.e. electrical feed lines such as round lines, flat lines and the like can be supplied to the connector 1 via the cable side 4. Furthermore, the connector 1 consists of a contact carrier sleeve 5, which has catch device 6 with which the connector 1 can be connected to a mating connector which is not shown. This catch device 6 is made for detachable attachment to another connector or also as a permanent catch device. As can be recognized in FIG. 1*b*, the catch device 6 projects beyond the contact carrier sleeve 5 so that it requires and takes up a certain additional space that will be required for installation of the connector. The same also follows from FIG. 1*c*, here it is shown that both the contact carrier 2 and the contact carrier sleeve 5 have a catch system 7. This catch system 7 is made, for example, as a peripheral recess in the contact carrier 2 and as a peripheral projection corresponding to it on the contact carrier sleeve 5. For assembly of the connector 1 it is provided that the contact carrier 2 and the contact carrier sleeve 5 are made separately from one another; for example, in a plastic injection molding process and then (looking at FIG. 1*c*) the contact carrier sleeve 5 is pushed from overhead over the contact carrier 2. To do this both the contact carrier 2 and also the contact carrier sleeve 5 have roughly rectangular cross sections corresponding to one another. Other symmetrical cross section shapes are within the scope of the present invention. To facilitate assembly when pushing the contact carrier sleeve 5 over the contact carrier 2 on its top end (on the cable side 4), the contact carrier 2 has a slight bevel. Depending on the intended use for the connector 1, for example in motor vehicle applications, there can be between the contact carrier 2 and the contact carrier sleeve 5 a peripheral seal 8 with which sealing is achieved between the connector 1 and its mating connector which is not shown. Thus the contact-making area between the connector 1 and the mating connector is protected against external contamination effects such as from moisture, dirt and the like.

FIGS. 1*d* and 1*e* show the connector 1 in perspective views, its being apparent from these views that the contact carrier 2 has at least two receiving areas 9 (chambers). There can be more receiving areas 9. These receiving areas 9 are used to hold contact partners such as plugs, sleeves, pins or the like (not shown) and are made such that a cable, a flat conductor or the like which has been provided on its end with the contact partner, is pushed from the cable side 4 into the contact carrier 2 and is fixed there in the receiving areas 9. This establishes a certain contact-making sequence or pattern which cannot be changed by the contact-making sequence which has been dictated by the mating connector. Likewise the contact carrier sleeve 5 which has been pushed over the contact carrier 2 and fixed, with its catch device 6 that requires additional installation space, is recognizable. This configuration of the connector 1 which is shown in FIGS. 1*d* and 1*e* therefore establishes the contact-making sequence of the contact partners in the receiving areas 9 and the location of the catch device 6, and a connector 1 which has been prefabricated in this way for a first application could be brought into contact with a mating connector. Other applications also being possible in which contact-making with a mating connector is not possible due to there being insufficient installation space, because in particular the catch device 6 which projects beyond the contact carrier sleeve 5 is in the way and prevents correct connection. To circumvent this problem it is provided that the contact carrier 2 and the contact carrier sleeve 5 are made symmetrical such that the contact carrier sleeve 5 can be fixed both in the position which is shown in FIG. 1*d* and also in at least one second position, this second position being shown in FIG. 2*d*. In a comparison of the corresponding FIGS. 1*d* and 2*d* it is apparent that the catch device 6 on the one hand is pointed to the right in examining FIGS. 1*b* and 1*c* and, on the other hand, is pointed to the left in examining FIGS. 2*b* and 2*c*. The symmetrical configuration of the connector 1 becomes especially apparent in a comparison of FIGS. 1*d* and 2*d* in which the contact carrier sleeve 5 is turned 180° as to how it is located on the contact carrier 2 in these two views. In this way, while maintaining the contact-making sequence (i.e., the arrangement of the contacts in the receiving areas 9) the contact carrier sleeve 5 can be moved first into a first position and then into a second position so that for example if the connector 1 cannot be installed in the one position for lack of installation space, but after turning the contact carrier sleeve 5 it can very probably be installed in the second position without a change of the contact-making sequence and also providing geometrical changes within the installation space that are necessary for the connector 1.

The figures show two receiving areas 9 of the connector 1 which are located in a row. It, of course, is conceivable here that in one row there are more than two receiving areas 9 for mating with the corresponding contact partners. Moreover there also can be several rows of receiving areas 9 on top of or under one another (i.e., tracks and grids).

What is claimed is:

1. A connector for at least two electrical conductors, said connector comprising:

a contact carrier including a contact-making side with at least two receiving parts disposed at said contact-making side, each of said receiving parts having a contact partner disposed to provide electrical contact to an electrical conductor; and a contact carrier sleeve having a catch device disposed to be attached to a second connector, said contact carrier sleeve having an opening disposed to fit about said contact carrier so that said contact carrier sleeve is fixed at a first rotational position about said contact carrier so that said contact carrier sleeve can be moved along a length of said contact carrier without rotation about said contact carrier from said first rotational position, and said contact carrier sleeve opening can be further disposed so that said contact carrier sleeve is fixed at a second rotational position about said contact carrier so that said contact carrier sleeve can be moved along the length of said contact carrier without rotation about said contact carrier from said second rotational position.

2. The connector according to claim 1, wherein the opening in said contact carrier sleeve is rectangular and an exterior surface of said contact carrier is rectangular so that said contact carrier sleeve opening is disposed about said contact carrier rectangular exterior surface.

3. The connector according to claim 1, further comprising:

a catch system means for detachably retaining said contact carrier sleeve to said contact carrier a longitudinal position along said contact carrier when said contact carrier sleeve opening is disposed to fit about said contact carrier.

4. The connector according to claim 1, further comprising:

a catch system means for permanently retaining said contact carrier at a longitudinal position along side contact carrier when said contact carrier sleeve opening is disposed to fit about said contact carrier.

5. The connector according to claim 1, further comprising:

a peripheral projection disposed to extend out from said contact carrier sleeve and into said contact carrier sleeve opening, and a peripheral recess disposed to extend into said exterior surface of said contact carrier, wherein said peripheral projection is disposed to fit into said peripheral recess when said contact carrier sleeve is disposed to fit about said contact carrier.

6. The connector according to claim 1, further comprising:

a peripheral recess disposed to extend into said contact carrier sleeve about said contact carrier sleeve opening, and a peripheral recess disposed to extend out from an exterior surface of said contact carrier, wherein said peripheral projection is disposed to fit into said peripheral recess when said contact carrier sleeve is disposed to fit about said contact carrier.

7. The connector according to claim 1, further comprising:

a bevel surface disposed on said contact carrier about a cable side surface on said contact carrier, said cable side surface disposed at an end of the length of said contact carrier and said contact-making side disposed at an opposite end of the length of said contact carrier from said cable side surface.

8. The connector according to claim 1, further comprising:

a seal means for forming a closure between said contact carrier sleeve opening and the length of said contact carrier.

* * * * *